US007111971B2

(12) United States Patent
Coushaine et al.

(10) Patent No.: US 7,111,971 B2
(45) **Date of Patent: *Sep. 26, 2006**

(54) LED LAMP WITH INSERTABLE AXIAL WIREWAYS AND METHOD OF MAKING THE LAMP

(75) Inventors: Charles M. Coushaine, Rindge, NH (US); Michael Tucker, Henniker, NH (US); Paul R. Lyman, Guilford, VT (US)

(73) Assignee: Osram Sylvania Inc., Danvers, MA (US)

( * ) Notice: Subject to any disclaimer, the term of this patent is extended or adjusted under 35 U.S.C. 154(b) by 0 days.
This patent is subject to a terminal disclaimer.

(21) Appl. No.: 11/292,206

(22) Filed: Dec. 2, 2005

(65) Prior Publication Data

US 2006/0072320 A1 Apr. 6, 2006

(51) Int. Cl.
*F21S 8/10* (2006.01)
*F21V 29/00* (2006.01)

(52) U.S. Cl. ..... 362/545; 362/294; 362/345; 362/373; 362/547

(58) Field of Classification Search ..... 362/294, 362/345, 373, 545, 547, 800
See application file for complete search history.

(56) References Cited

U.S. PATENT DOCUMENTS

| | | | | |
|---|---|---|---|---|
| 6,621,222 | B1 * | 9/2003 | Hong | 315/51 |
| 6,682,211 | B1 * | 1/2004 | English et al. | 362/545 |
| 6,773,138 | B1 * | 8/2004 | Coushaine | 362/656 |
| 7,008,095 | B1 * | 3/2006 | Coushaine et al. | 362/545 |
| 2005/0047145 | A1 * | 3/2005 | Coushaine et al. | 362/294 |

* cited by examiner

*Primary Examiner*—Sandra O'Shea
*Assistant Examiner*—James W Cranson, Jr.
(74) *Attorney, Agent, or Firm*—William E. Meyer

(57) ABSTRACT

An LED lamp and a method of making an LED lamp in which the lamp includes a heat conductive post with a base and a top, an insulative body within the post that includes plural wireways and plural electrical leads that each extend through a different one of the wireways and whose ends emerge from the top and the base of the post, a head with plural LED assemblies on the top of the post, and a circuit board for the LED assemblies at the base of the post, the leads being connected to respective LED assemblies and to the circuit board. During manufacture, the leads are mounted in the wireways of the insulative body and the assembled body is inserted into the post.

15 Claims, 10 Drawing Sheets

LED LAMP WITH INSERTABLE AXIAL WIREWAYS AND METHOD OF MAKING THE LAMP

The Applicants hereby claim the benefit of their application, Ser. No. 10/647,831 filed Aug. 25, 2003 for LED LAMP WITH INSERTABLE AXIAL WIREWAYS AND METHOD OF MAKING THE LAMP.

The Applicants hereby claim the benefit of their provisional application Ser. No. 60/461,937 filed Apr. 10, 2003 for "LED Bulb and Basing Concept."

BACKGROUND OF THE INVENTION

The present invention is directed to a lamp with plural light-emitting diode (LED) assemblies that are carried on a post surrounded by a reflector, and to a method of making such a lamp.

As is known, light output of a LED device depends on its temperature. Temperature must be kept low to ensure efficient light production. Accordingly, it is beneficial to provide an LED lamp that includes plural LED assemblies with a heat sink for drawing heat away from the LED assemblies.

It is also desirable to provide a reflector for concentrating light from the plural LED assemblies. The LED assemblies may be mounted on a post so that the LED assemblies are surrounded by and spaced from the reflector. A circuit board provides the necessary electrical components and connections for operating the LED assemblies that are carried on the post.

However, the arrangement of the reflector, heat sink, circuit board, and post in an LED lamp with plural LED assemblies and the efficient assembly of these components have presented problems for designers of such lamps. One of the problems is how to efficiently connect LED assemblies that are carried on top of the post to a circuit board when the circuit board is carried at a base of the post and when the heat sink and reflector are also carried at the base of the post. Heat must conducted away from the LED assemblies at the top of the post to the heat sink at the bottom of the post and electrical connections must be made from the circuit board at the bottom of the post to the LED assemblies at the top of the post, and the arrangement of the components must facilitate automated manufacture of the lamp.

SUMMARY OF THE INVENTION

An object of the present invention is to provide a novel LED lamp and method of making an LED lamp that facilitates assembly of the lamp.

A further object of the present invention is to provide a novel LED lamp and method of making the lamp in which electrical leads for connecting the LED assemblies to the circuit board are pre-wired in an insulated body that is inserted into the post that supports the LED assemblies.

A yet further object of the present invention is to provide a novel LED lamp and method of making the LED lamp in which the lamp includes a heat conductive post with a base and a top, an insulative body within the post that includes plural wireways and plural electrical leads that each extend through a different one of the wireways and whose ends emerge from the top and the base of the post, a head with plural LED assemblies on the top of the post, and a circuit board for the LED assemblies at the base of the post, where the leads are connected to respective LED assemblies and to the circuit board.

These and other objects and advantages of the invention will be apparent to those of skill in the art of the present invention after consideration of the following drawings and description of preferred embodiments.

DESCRIPTION OF PREFERRED EMBODIMENTS

Figure 1:
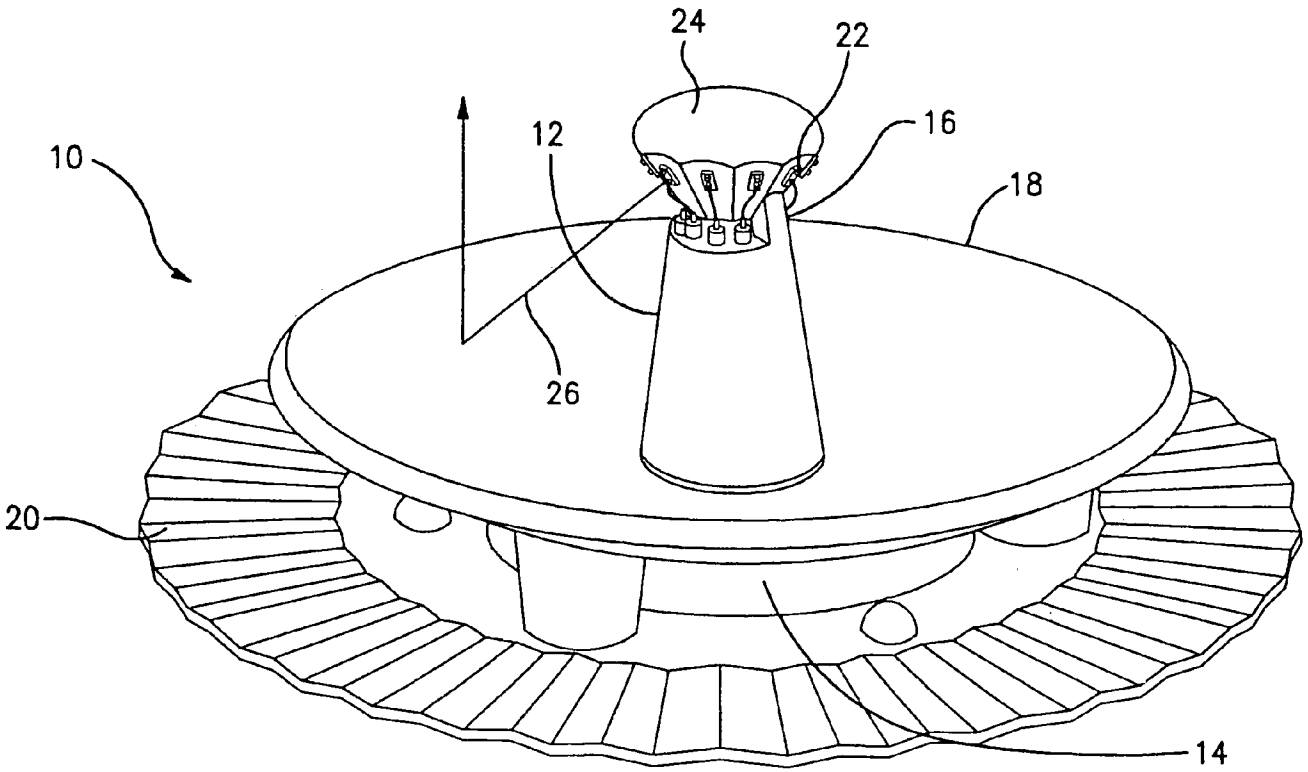
FIG. 1 is a pictorial representation of an embodiment of an LED lamp of the present invention.
Figure 2:
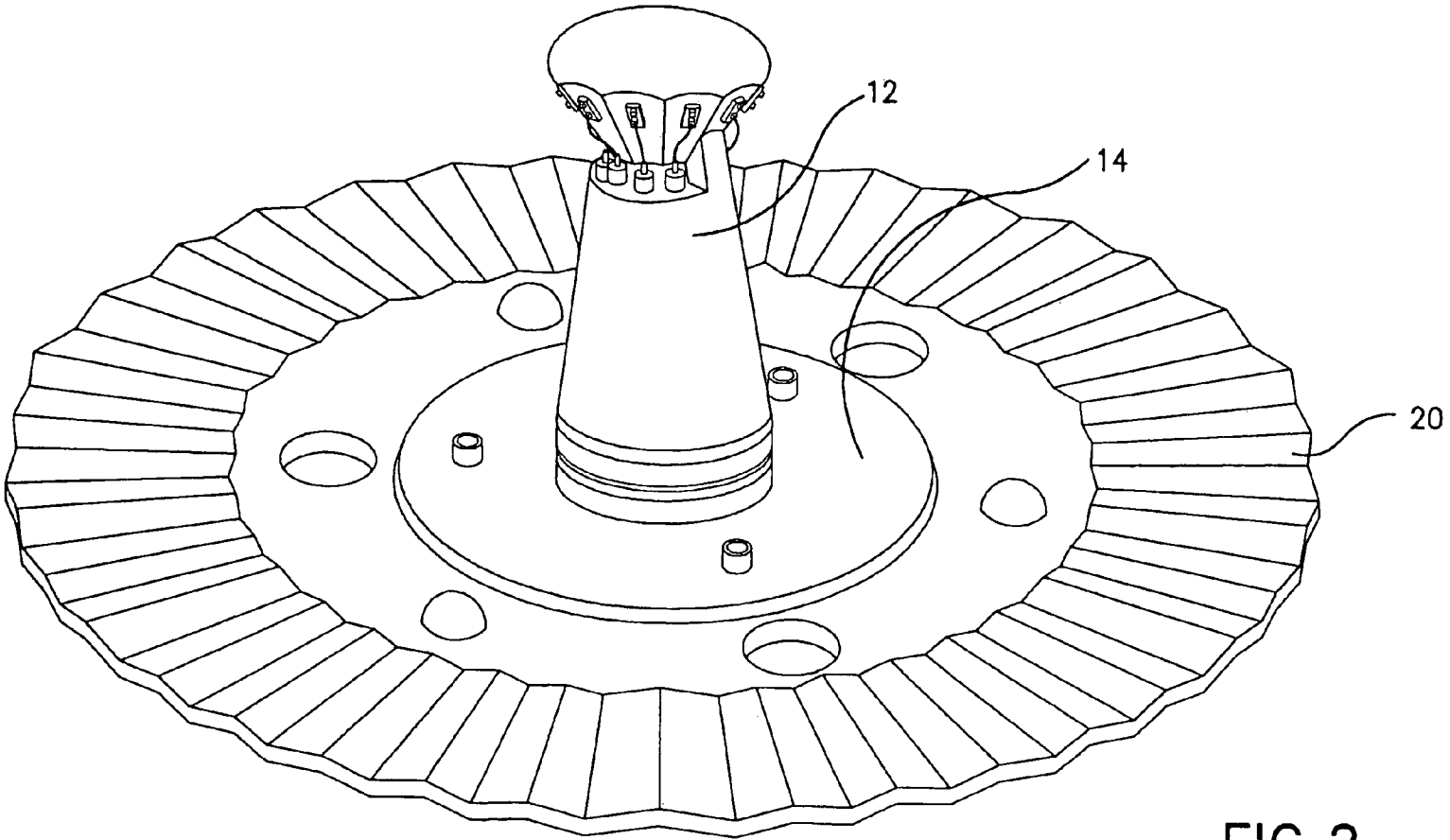
FIG. 2 is a pictorial representation of the embodiment of FIG. 1 with the reflector removed.
Figure 3:
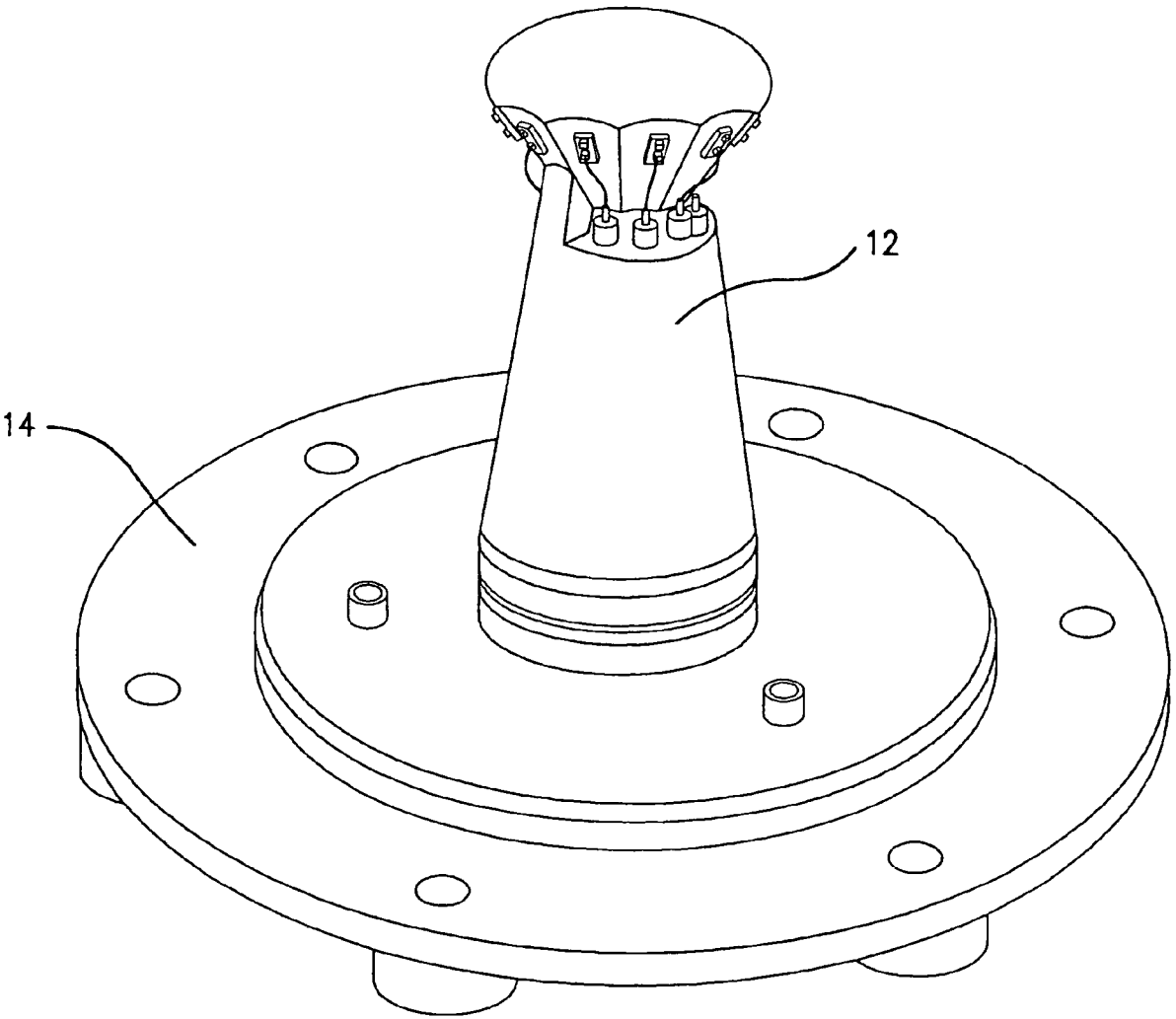
FIG. 3 is a pictorial representation of the embodiment of FIG. 2 with the heat sink removed
Figure 4:
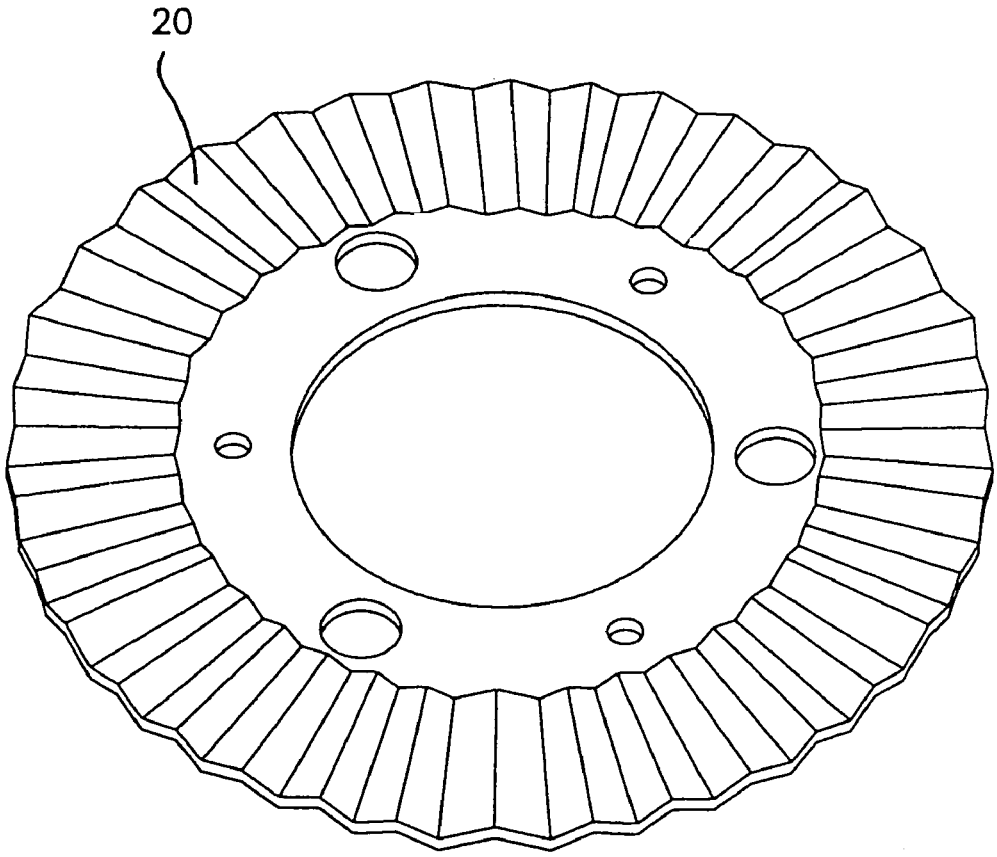
FIG. 4 is a pictorial representation of a heat sink for the lamp of the embodiment of FIG. 1.
Figure 5:
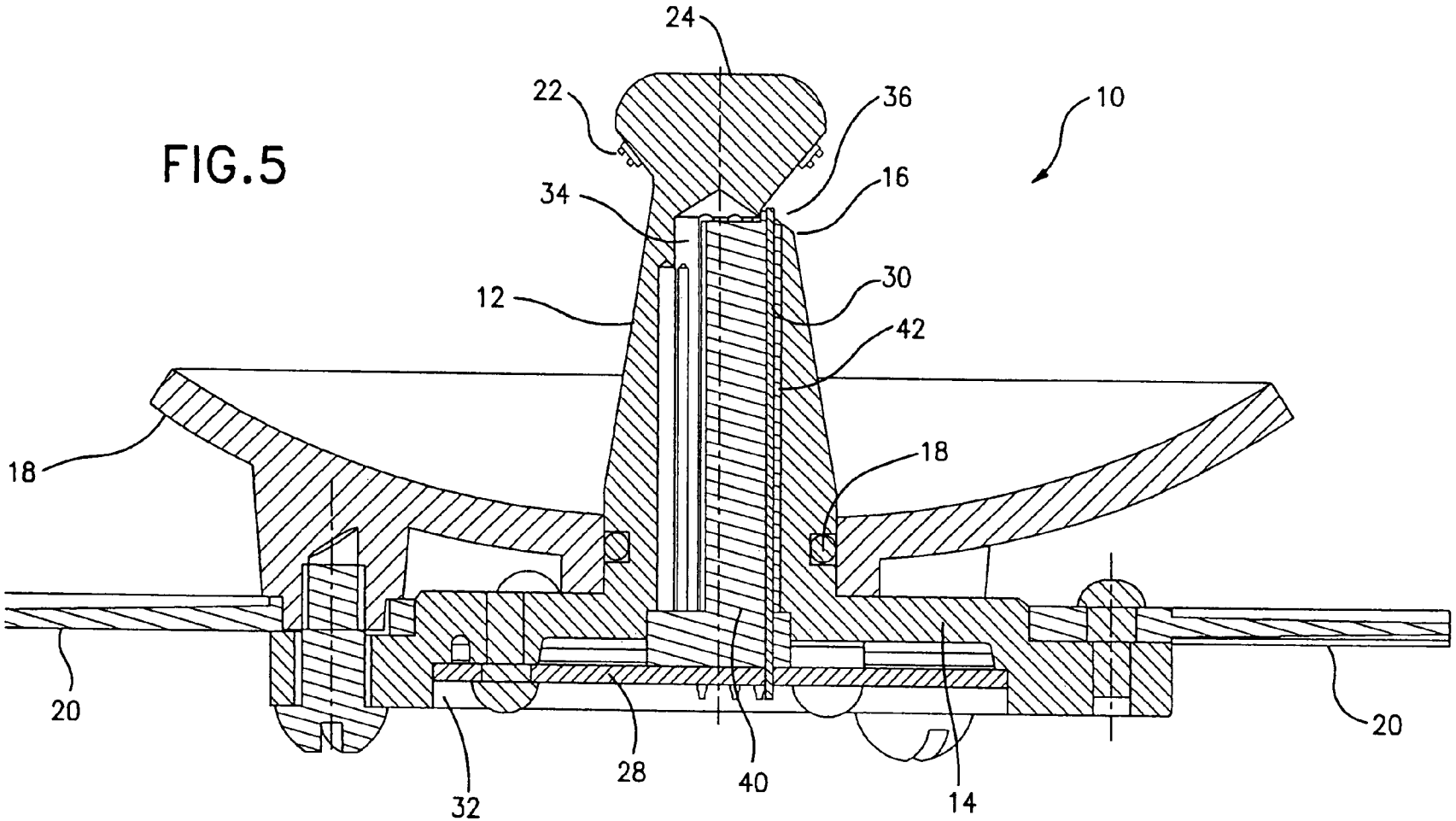
FIG. 5 is a vertical cross sectional view of the embodiment of FIG. 1.

With reference now to FIG. 1, an embodiment of an LED lamp 10 of the present invention includes a heat conductive post 12 having a base 14 and a top 16, a reflector 18 attached to base 14 and a heat sink 20 attached to base 14. The attachment of reflector 18 and heat sink 20 to base 14 is apparent from FIGS. 2–3 that show, in sequence, lamp 10 with reflector 18 removed, then with heat sink 20 removed. An embodiment of heat sink 20 is shown in FIG. 4 and may be any suitable material, such as cast zinc or aluminum. Suitable fasteners (such as shown in FIG. 5) hold reflector 18 and heat sink 20 to base 14. The reflector, heat sink and fasteners shown in the figures are offered by way of example, with other designs, shapes and sizes being adaptable to the present invention as appropriate for a particular purpose, size and design of the lamp.

LED assemblies 22 are mounted on a periphery of a head 24 that is on top 16 of post 12. Head 24 may include flat portions for receiving LED assemblies 22. The number of LED assemblies 22 depends on the application for the lamp, and in one embodiment ten LED assemblies 22 are mounted on respective flat portions around a periphery of head 24. As illustrated by light beam 26, reflector 18 and LED assemblies 22 are arranged so that light from LED assemblies 22 is directed to reflector 18 and reflected in a manner suitable for the purpose of lamp 10. As will be explained further below, a circuit board 28 with components for operating LED assemblies 22 may be carried at a bottom of base 14 and connected to LED assemblies 22 with electrical leads 30.

The connection of LED assemblies 22 to circuit board 28 will now be discussed with reference to FIG. 5 that shows the embodiment of FIG. 1 in cross section. Initially, it is to be noted that base 14 may be an annular extension of a bottom of post 12 and head 24 may be an extension of top 16 at the other end of post 12. The entirety of post 12, including base 14, top 16 and head 24 desirably is one piece of metal that has high thermal conductivity, such as cast zinc that may be metallized for aesthetics. Several parts could be joined to form post 12, but assembly would be more difficult and heat conduction may be impaired. Base 14 may be stepped to receive heat sink 20 and have appropriate connections and an O-ring 18' for securing reflector 18. Base 14 has a central recess 32 therein that receives circuit board 28 (the circuitry not being shown as it is known to those of skill in the art). Recess 32 has sufficient depth so that circuit board 28 does not protrude.

A center part of post 12 has an axial opening 34 extending from base 14 to top 16. Opening 34 may be unobstructed at base 14 and closed at top 16, except for holes 36 through which electrical leads 30 emerge. Electrical leads 30 are carried by an insulative body 40 that may be inserted into opening 34 before attachment of circuit board 28. Insulative body 40 defines wireways 42 that electrically isolate electrical leads 30 from each other.

The size and shape of insulative body 40 and of opening 34 are coordinated so that insulative body 40 is insertable into opening 34 in an automated process. Electrical leads 30 are mated with wireways 42 in insulative body 40 before inserting insulative body 40 into opening 34 so that ends of electrical leads 30 extend beyond insulative body 40. As will be shown later, the extended ends are attached to circuit board 28 and LED assemblies 22. The number and spacing of wireways 42 corresponds to the number and spacing of LED assemblies 22. Preferably, the extended ends of electrical leads 30 will be positioned near respective ones of LED assemblies 22. Wireways 42 need not be parallel or straight and may be aligned so that leads extend to circuit board 28 in appropriate locations.

Insulative body 40 may be any appropriate electrically insulative material that can withstand the heat generated in post 12, such as some plastics and ceramics. Electrical leads 30 have at least a gauge suitable for carrying a current needed to operate LED assemblies 22. Preferably, electrical leads 30 are rigid enough so that the extended ends can be inserted into openings 36 when insulative body 40 is inserted into opening 34 during the manufacturing process and to this end may be thicker than needed for the current load. A wire diameter of at least about 0.5 mm is suitable for this purpose. Electrical leads 30 may be placed within wireways 42 after insulative body 40 has been formed, such as by lengthwise snap-fitting or by longitudinal insertion, or may be placed within insulative body 40 during its formation.

Figure 6A:
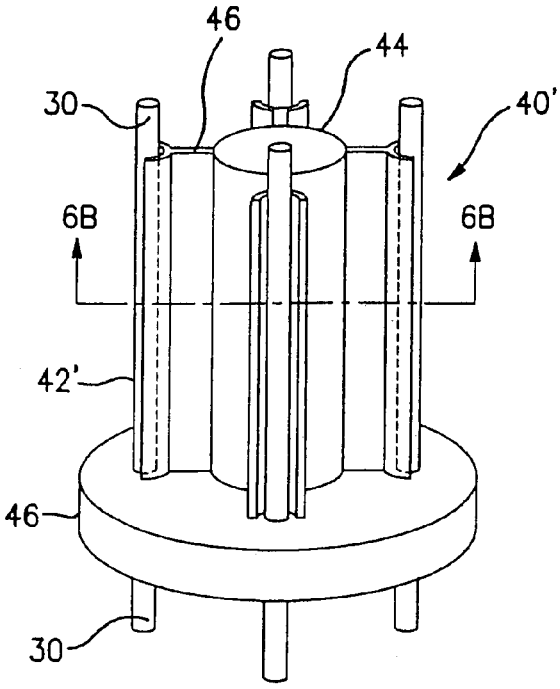
FIGS. 6(*a*)–(*b*) are a pictorial representation of one embodiment of an insulative body of the present invention and a cross section thereof.
Figure 6B:
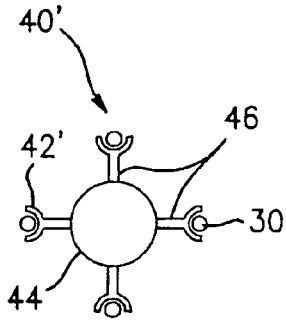
Figure 7A:
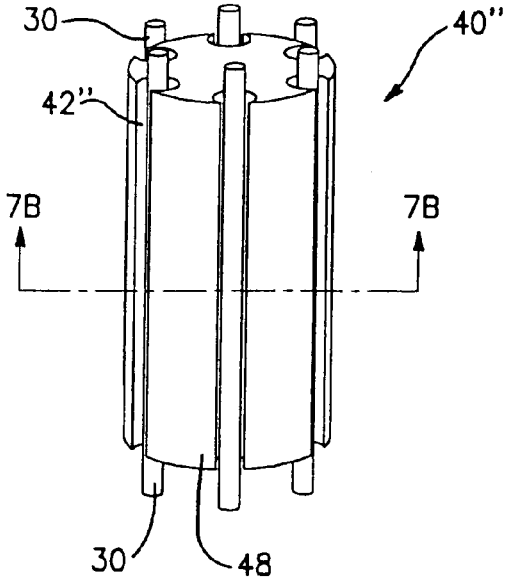
FIGS. 7(*a*)–(*b*) are a pictorial representation of a further embodiment of an insulative body of the present invention and a cross section thereof.
Figure 7B:
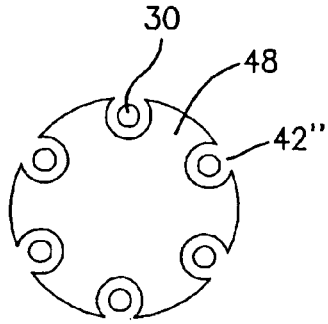

FIGS. 6(*a*)–(*b*) and 7(*a*)–(*b*) illustrate two embodiments of an insulative body 40 suitable for the present invention, with other shapes being derivable from this disclosure. The embodiment 40' of FIGS. 6(*a*)–(*b*) includes a core 44 with radial fins 46 whose ends define wireways 42'. Electrical leads 30 may be snap fit lengthwise into wireways 42' or otherwise mated therewith. A bottom 46 optionally may be provided to close opening 34. The embodiment of FIGS. 7(*a*)–(*b*) includes a fluted core 48 with longitudinal grooves that define wireways 42". Electrical leads 30 may be snap fit lengthwise into wireways 42" or otherwise mated therewith.

Figure 8A:
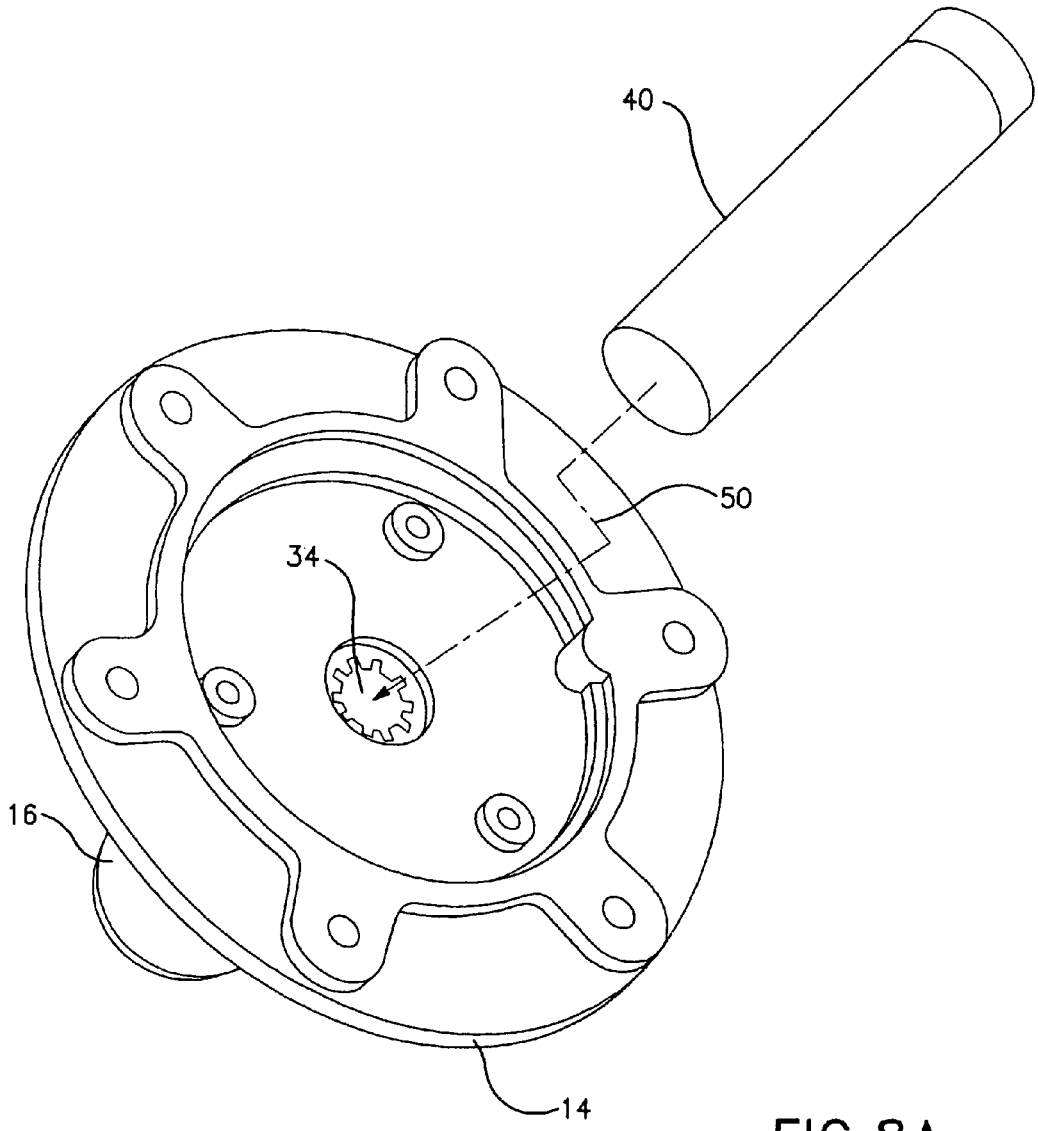
FIGS. 8(*a*)–(*c*) are pictorial representations showing a sequence of assembly of the embodiment of FIG. 1.
Figure 8B:
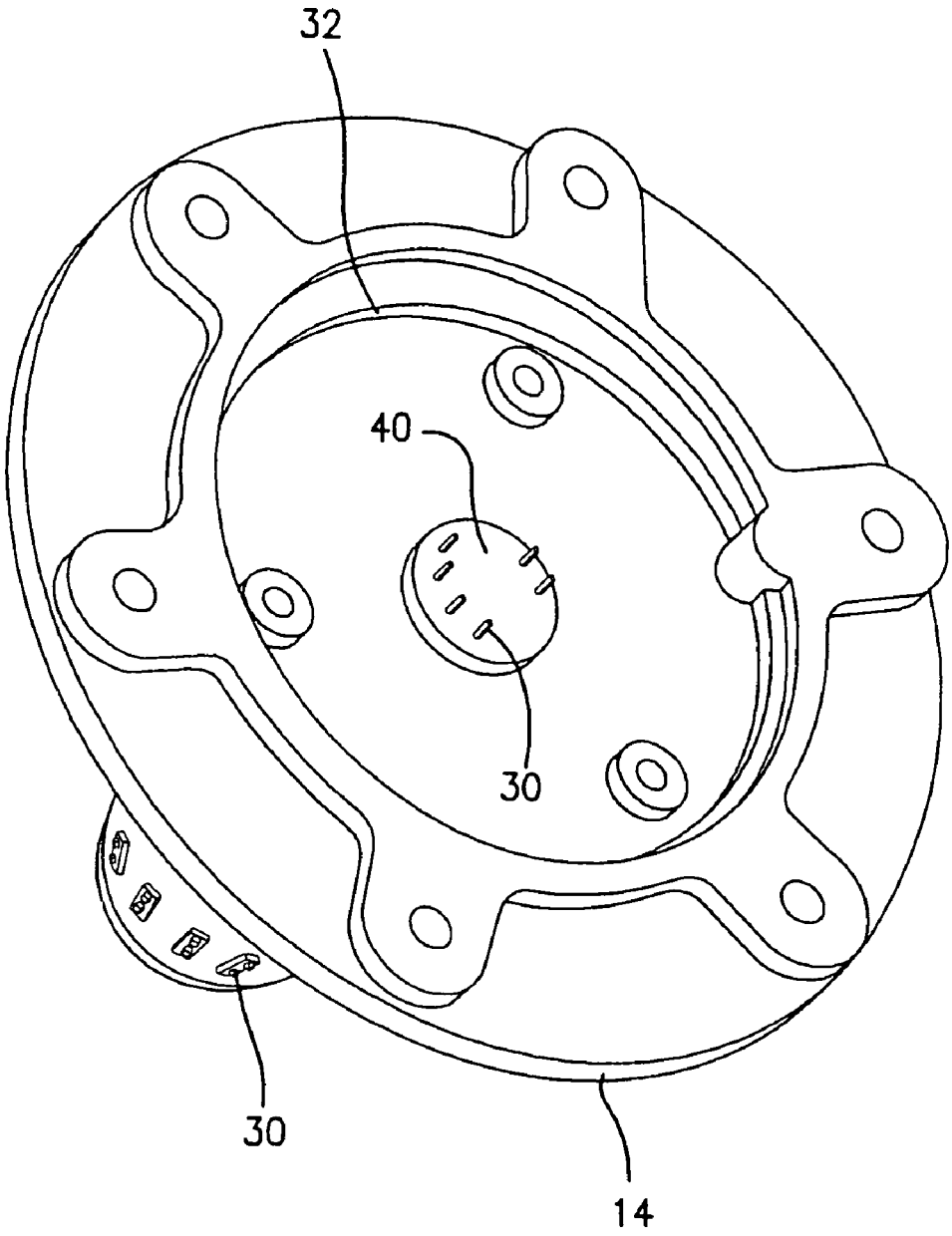
Figure 8C:
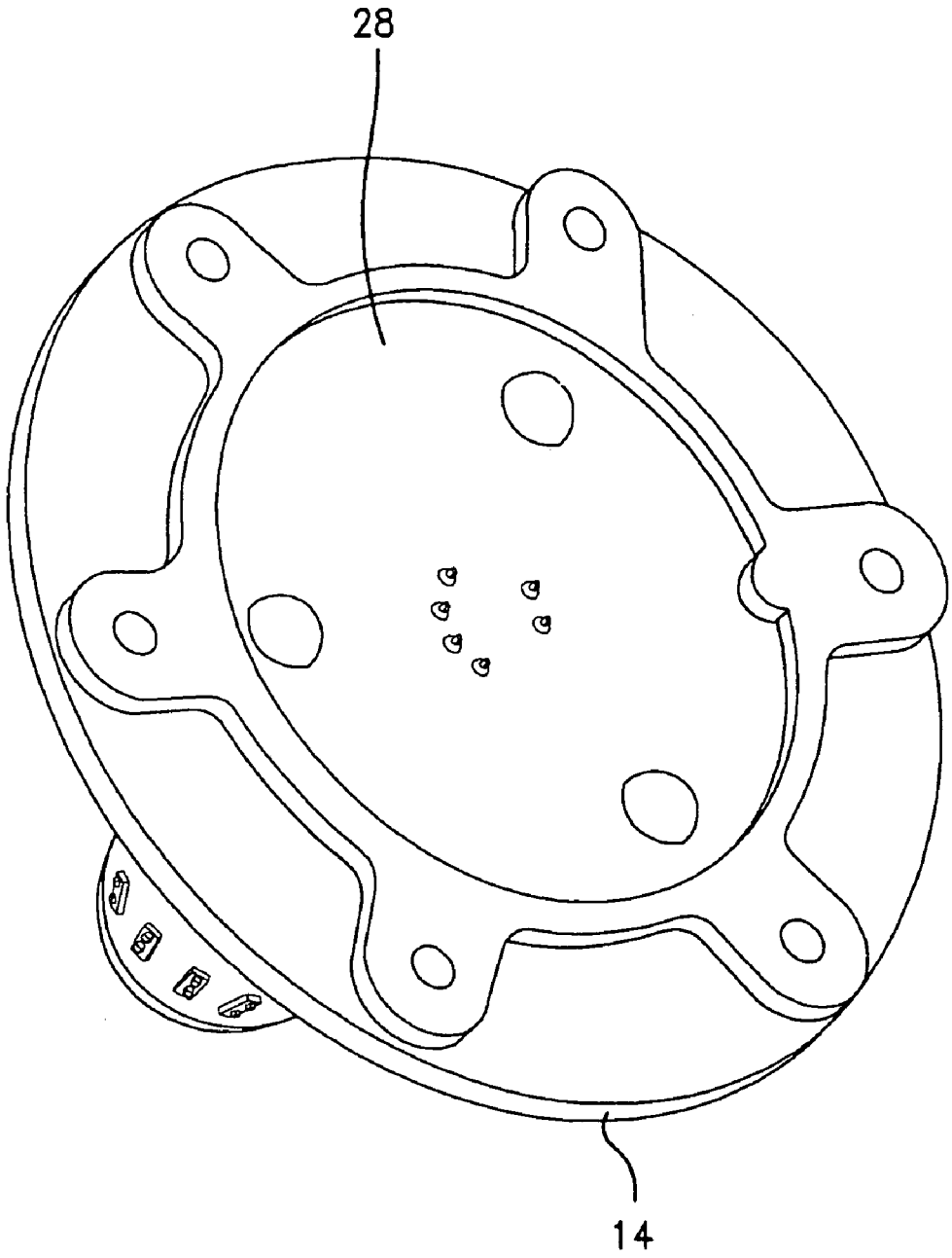

FIGS. 8(*a*)–(*c*) illustrate a sequence of assembly of base 14, insulative body 40 and circuit board 28. As is apparent, opening 34 appears at the bottom of base 14. Opening 34 may be sized and shaped to receive insulative body 40, which may be inserted into opening 34 as indicated by arrow 50. Once insulative body 40 has been inserted into opening 34, the extended ends of electrical leads 30 emerge from base 14 and top 16. Circuit board 28 may then be placed in recess 32. Extended ends of electrical leads 30 desirably project from an exposed side of circuit board 28 to facilitate connection of electrical leads 30 to appropriate circuitry on circuit board 28. Appropriate fasteners are driven home and lamp 10 appears as shown in FIG. 5.

Figure 9:
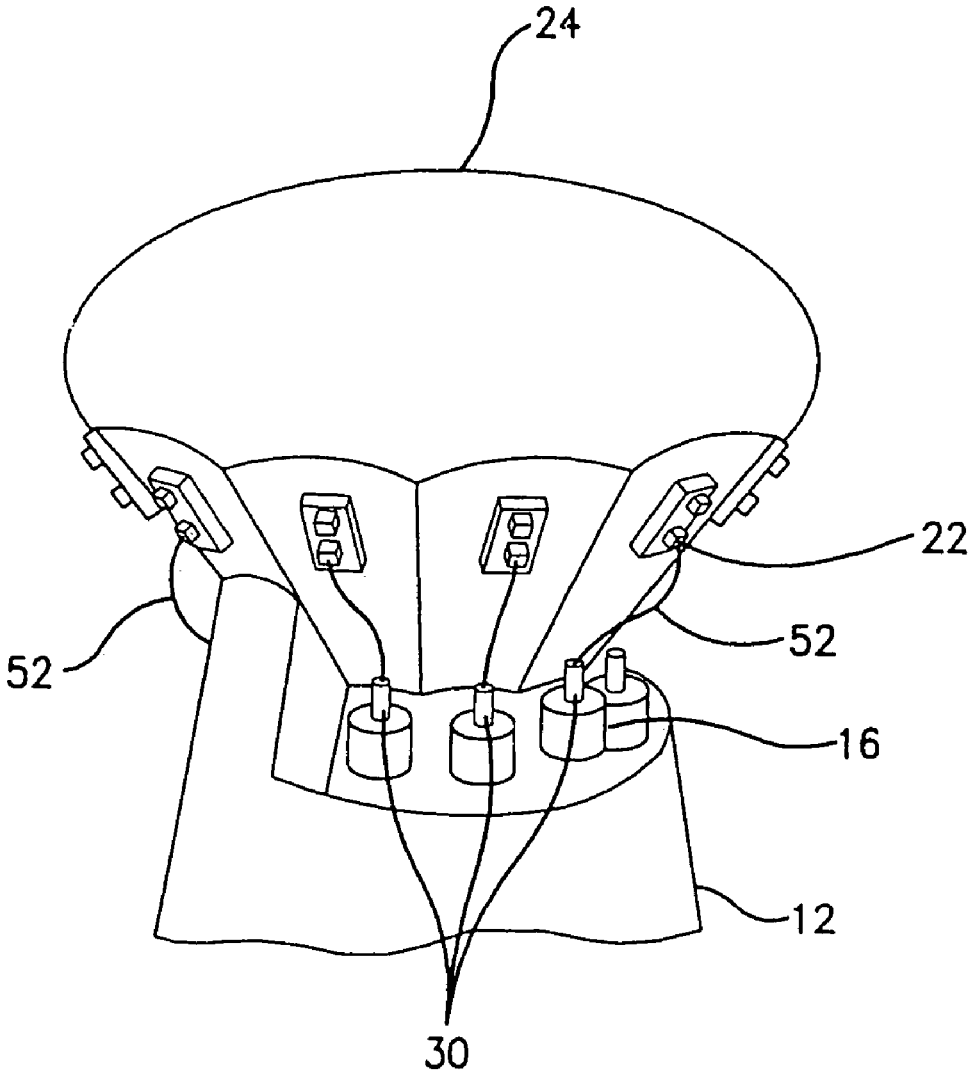
FIG. 9 is a partial pictorial representation of the LED assemblies of the embodiment of FIG. 1 and their connection to the ends of the electrical leads.

A further step illustrated in FIG. 9 includes connection of the extended ends of electrical leads 30 to LED assemblies 22 with connecting wires 52. Alternatively, the extended ends may be directly connected to LED assemblies 22, such as by soldering or welding. Heat sink 20 and reflector 18 can be attached at this time.

The LED lamp and method described herein provides several production advantages. For example, the electrical leads are production rigid, the space for the circuit board is sufficiently large to permit component separation and thermal dissipation, the connection of electrical leads to the circuit board can be highly automated, the heat sink can have myriad shapes as needed for particular applications, and the fit tolerance of the various parts is such that manufacturing cost and complexity is reduced.

While embodiments of the present invention have been described in the foregoing specification and drawings, it is to be understood that the present invention is defined by the following claims when read in light of the specification and drawings.

We claim:

1. A lamp comprising:

a heat conductive post having a base and a top and plural wireways extending axially through said post from the base to the top;

a head on the top of said post, said head having plural light-emitting diode (LED) assemblies mounted thereon;

a circuit board for said LED assemblies at the base of said post; and plural electrical leads that are insulated from each other and that each extend through a different one of said wireways and whose ends emerge from the base and the top, said leads being connected to respective ones of said LED assemblies and to said circuit board.

2. The lamp of claim 1, wherein said post has an axial opening therein and wherein said plural wireways are in an insulative body that is carried within said opening.

3. The lamp of claim 2, wherein said insulative body comprises plural axial shafts that form said wireways.

4. The lamp of claim 1, further comprising a reflector attached to the base of said post.

5. The lamp of claim 1, further comprising a heat sink attached to the base of said post.

6. The lamp of claim 1, wherein said LED assemblies are distributed around a periphery of said head and said leads emerge from the top of said post adjacent to respective ones of said LED assemblies, said leads being connected to said LED assemblies with connecting wires.

7. A method of making a lamp, comprising the steps of:

providing a heat conductive post having a base and a top;

providing an insert that includes plural wireways and plural electrical leads that are insulated from each other and that each extend through a different one of the wireways;

inserting the insert into the post so that ends of the leads emerge from the top and the base of the post;

providing a head having plural LED assemblies on the top of the post;

mounting a circuit board for the LED assemblies at the base of the post; and connecting the leads to respective ones of the LED assemblies and to the circuit board.

8. The method of claim 7, wherein the post has an axial opening therein and wherein the insert has an insulative body that is inserted into the opening during the inserting step.

9. The method of claim 8, wherein the insulative body includes plural axial shafts that form the wireways.

10. The method of claim 7, further comprising the step of attaching a reflector to the base of the post.

11. The method of claim 7, further comprising the step of attaching a heat sink to the base of the post.

12. The method of claim 7, further comprising the step of mounting the circuit board in a recess in the base of the post.

13. The method of claim 7, further comprising the step of connecting the ends of the leads to the LED assemblies with connecting wires.

14. A lamp comprising:

a heat conductive post having a base and a top and an axial opening therein;

an insulative body within said opening, said body defining plural wireways;

plural electrical leads that are insulated from each other and that each extend through a different one of said wireways and whose ends emerge from the base and the top of said post;

a head on the top of said post, said head having plural LED assemblies mounted around a periphery thereof, said LED assemblies being connected to respective ones of said leads;

a circuit board for said LED assemblies in the base of said post, the ends of said leads extending into said circuit board and being electrically connected thereto; and a reflector attached to the base of said post; and a heat sink attached to the base of said post.

15. The lamp of claim 14, wherein said leads emerge from the top of said post adjacent to respective ones of said LED assemblies and wherein said leads are connected to said LED assemblies with connecting wires.

* * * * *